United States Patent [19]

Brockhaus

[11] Patent Number: 4,675,940

[45] Date of Patent: Jun. 30, 1987

[54] HINGE ASSEMBLY FOR MOTOR VEHICLE DOORS

[75] Inventor: Ernst Brockhaus, Remscheid-Hasten, Fed. Rep. of Germany

[73] Assignee: Ed. Scharwächter GmbH & Co. KG., Remscheid, Fed. Rep. of Germany

[21] Appl. No.: 651,600

[22] Filed: Sep. 17, 1984

[30] Foreign Application Priority Data

Sep. 19, 1983 [DE] Fed. Rep. of Germany ..... 3333796
May 8, 1984 [DE] Fed. Rep. of Germany ..... 3416960

[51] Int. Cl.[4] ..... E05D 7/12

[52] U.S. Cl. ..... 16/273; 16/254; 16/385; 16/387

[58] Field of Search ..... 16/254, 257, 260–263, 16/270, 273, 380, 383, 385–387, DIG. 33; 308/DIG. 9

[56] References Cited

U.S. PATENT DOCUMENTS

| | | | |
|---|---|---|---|
| 502,706 | 8/1893 | Corscaden et al. | 16/273 |
| 1,378,149 | 5/1921 | Teisseire | 16/262 |
| 1,596,470 | 8/1926 | Way et al. | 16/386 |
| 1,909,990 | 5/1933 | Weller | 16/273 |
| 1,920,466 | 8/1933 | Haskins et al. | 16/386 |
| 3,209,391 | 10/1965 | Mangini | 16/386 |
| 4,353,146 | 10/1982 | Brockhaus | 16/273 |
| 4,383,478 | 5/1983 | Jones | 16/273 |

FOREIGN PATENT DOCUMENTS

| | | | |
|---|---|---|---|
| 2013122 | 9/1971 | Fed. Rep. of Germany | 16/273 |
| 314676 | 7/1929 | United Kingdom | 16/273 |

*Primary Examiner*—Donald R. Schran
*Assistant Examiner*—James L. Wolfe
*Attorney, Agent, or Firm*—Toren, McGeady & Associates

[57] ABSTRACT

A hinge assembly particularly for mounting the door of a motor vehicle having a first and a second hinge wing with first and second hinge eyes, respectively, thereon, a hinge pin operatively interposed between said first and second hinge eyes and a knurled portion interposed between the hinge pin and one of the first and second hinge eyes to effect nonrotative relative engagement therebetween. A bushing of maintenance-free bearing material is interposed between the hinge pin and the other of the first and second hinge eyes and a liner made of high strength material is inserted in the bushing between the hinge pin and the bushing. The knurled section may extend over the hinge pin at least one and one-half times the length required for securely fixing the hinge pin.

14 Claims, 10 Drawing Figures

HINGE ASSEMBLY FOR MOTOR VEHICLE DOORS

The present invention relates generally to door hinge assemblies and more particularly to a hinge assembly particularly suitable for mounting the door of a motor vehicle.

An assembly of the type to which the present invention relates generally comprises a hinge pin which is supported so as to be maintenance free, the hinge pin being nonrotatably fastened in a center hinge eye or gudgeon of one hinge wing of the hinge assembly with a running fit by means of a collar bush of maintenance-free bearing material and nonrotatably fastened in at least one of the two external hinge eyes of the other hinge wing by means of a circumferential knurl wherein the end face of the hinge pin, which is located in the front taken in the direction of insertion of the hinge pin, is equipped with means for exact calibration and smoothing of the material of the bush of maintenance-free bearing material.

In modern automobile manufacture, it is required to an increasing extent not only that the door hinges of the motor vehicle be of high strength and maintenance free, but also that they can be temporarily removed from the body at least during assembly of the inner furnishings or trim of the motor vehicle and that they be subsequently installed again on the body in an exact fitted position set up during production of the vehicle shell. Furthermore, it is required that this be capable of accomplishment without complex procedures or additional expenses. In the prior prior art, several separable door hinge structures for motor vehicles intended to fulfill the requirements thereof are already known.

The present invention proceeds from a motor vehicle door hinge assembly having a hinge pin supported in a maintenance-free manner in which the hinge pin is supported with a running fit in the central hinge eye of one hinge wing by means of a collar bushing of maintenance-free bearing material and the exact calibration and smoothing of the surface of the collar bush during the insertion of the hinge pin is effected by means of its end located forwardly taken in the direction of insertion of the hinge pin, which end is equipped with corresponding means. With this manner of construction of motor vehicle door hinges, the invention is aimed toward the formation of the hinge assembly so as to enable separation thereof without substantially increasing the cost of production and, particularly, without impairing the fitting accuracy of the hinge pin bearing and the fixing or placing of the hinge pin in at least one of two external hinge eyes of the other hinge wing by means of removal of the hinge pin. In so doing, the invention enables the safe elimination of the danger of corrosion of the hinge eye bore hole or hinge pin in the central area of the hinge eye bore hole of the central hinge eye of one of the hinge wings.

SUMMARY OF THE INVENTION

Briefly, the present invention may be described as a hinge assembly for supporting a motor vehicle door in a maintenance-free manner comprising: a first hinge wing having first hinge eye means; a second hinge wing having second hinge eye means; one of said first and second hinge eye means comprising a center hinge eye and the other comprising two external hinge eyes juxtaposed with said central hinge eye therebetween; a hinge pin operatively engaged between said first and second hinge eye means, said hinge pin being shaped at one end thereof to facilitate insertion into said first and second hinge eye means; knurl means interposed between said hinge pin and one of said first and second hinge eye means to effect nonrotatable relative engagement therebetween; bushing means made of maintenance-free bearing material interposed between said hinge pin and the other of said first and second hinge eye means; and a liner made of high strength material inserted in said bushing means between said hinge pin and said bushing means; said knurl means extending over said hinge pin at least one and one-half times the length required for securely fixing said hinge pin.

Thus, in accordance with the invention, the objectives thereof are achieved in that a lining of high strength material is inserted in the bushing means which comprise a collar bush of maintenance-free bearing material and which may be provided in the central hinge eye of said one hinge eye means and the circumferential knurl at the hinge pin having at least one and one-half times the length of that actually required for the secure fixing of the hinge pin.

The various features of novelty which characterize the invention are pointed out with particularity in the claims annexed to and forming a part of this disclosure. For a better understanding of the invention, its operating advantages and specific objects attained by its use, reference should be had to the drawings and descriptive matter in which there are illustrated and described preferred embodiments of the invention.

DETAILED DESCRIPTION OF THE PREFERRED EMBODIMENTS

Figure 1:
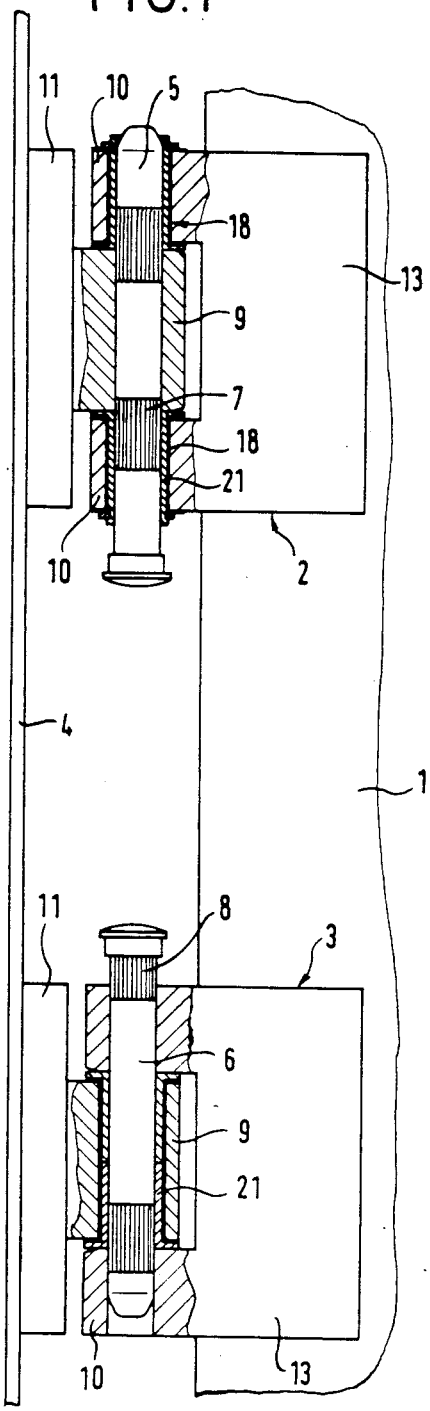
FIG. 1 is a sectional side view showing two hinges of a vehicle door arranged only in a preassembled condition.
Figure 2:
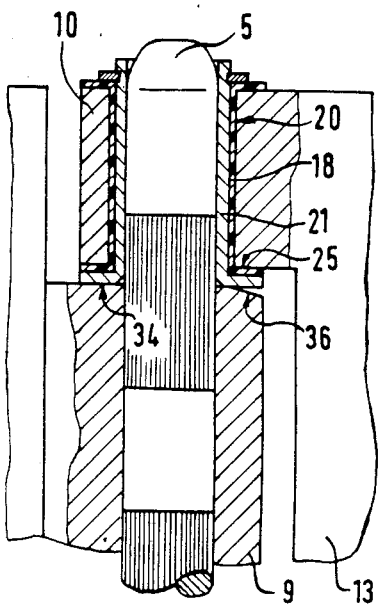
FIG. 2 is a sectional view showing the upper door hinge of FIG. 1 on an enlarged scale.
Figure 3:
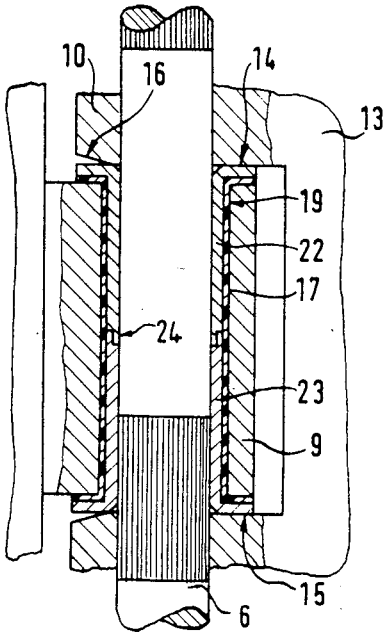
FIG. 3 is a sectional view showing the lower door hinge of FIG. 1 also on an enlarged scale.

Referring now to the drawings and particularly to FIGS. 1, 2 and 3, there is shown a first embodiment of the invention comprising a hinge assembly for a vehicle door 1 which is shown only schematically and which is removably fastened at a door brace 4 which is also only shown schematically. The door brace 4 is part of a vehicle body and the door 1 is attached thereto by means of an upper door hinge assembly 2, which is shown in greater detail in FIG. 2, and a lower door hinge assembly 3 which is shown in greater detail in FIG. 3.

At the stage of assembly shown in FIG. 1, the door is fitted in the vehicle body before it is temporarily removed, possibly in order to enable painting of the body, but particularly, for enabling unhindered installation of inner furnishings. The door may then be again inserted on the vehicle body finally at the end of the assembly procedure of the vehicle.

During the assembly procedure, the door 1 may be removed by separating the two hinges 2 and 3. It will be noted that the hinges comprise hinge pins 5 and 6, respectively, and it will be seen that, as shown in FIG. 1, the hinge pins are inserted only partially and may be removed in order to separate the hinges 2 and 3.

Each of the hinge pins 5 and 6 is provided with a circumferential knurl 7 and 8 with which the pin may be made to engage with a hinge eye 9 or 10 of one of the hinge wings 11 or 13 of the two hinges 2 and 3 so as to be nonrotatable relative thereto. In the state of assembly shown, the hinge pins 5 and 6 are inserted only into the respective hinge eye 9 or 10 to a partial extent of the height of their circumferential knurls 7 or 8 so that they can be easily removed and subsequently reinserted into the respective hinge eye 9 or 10. When reinserted, the hinge pins may be inserted to the full height of their circumferential knurls 7 and 8 and, accordingly, affixed in the assembled condition.

For this purpose, the circumferential knurls 7, 8 are constructed so as to be somewhat of a greater length than would actually be required for simple fixing of the hinge pin 5 or 6. It will be seen, additionally, from FIG. 1, that the two hinges 2 and 3 are arranged in such a manner that the hinge pin 5 of the upper hinge 2 can be pulled out downwardly and so that the hinge pins 6 of the lower hinge 3 can be pulled out upwardly. In order to facilitate reinstallation of the door 1, two inner surfaces 14 and 15 of the two external hinge eyes 10 of the other hinge wing 13, which inner surfaces 14 and 15 face one another, are, as will be seen in particular from FIGS. 2 and 3, provided with a sloping configuration 16 which rises and falls in opposite directions outwardly. The position of the sloping surfaces 16 is determined according to the opening angle of the door which is favorable for insertion of the door. The hinge pins 5 and 6 are supported, indirectly, in that the hinge eye 9 or in that the hinge eye 10, in which they are to have a running fit by means of bushings 17 and 18, are made of a maintenance-free bearing material. As indicated in FIGS. 2 and 3, the bushings 17 and 18 are preferably constructed as collar bushings and they are nonrotatably anchored in the respective hinge eye bore holes 19 or 20.

In order to prevent destruction of or damage to the bushings 17 and 18 when removing and reinserting the hinge pins 5 or 6, the hinge assemblies are provided with linings 21 made of a high strength material which are connected with the hinge pin 5 or 6 so as to be nonrotatable relative thereto and preferaby in an interlocked connection and, possibly, also having a forced connection. In the embodiment shown, the linings of high strength material formed by means of two sleeve-like parts 22 and 23 constructed as collar bushes which are provided with radially directed, circulating recesses or slopings 24, in the area of their end faces are adjacent one another. By means of the recesses or slopings 24, the two sleeve-like parts 22 and 23 overlap one another and may form an approximately annular radially outwardly directed bead or the like, on the one hand, by means of which the linings of high strength material in the bushings of the maintenance-free bearing material 17 and 18 may be secured in the axial direction.

On the other hand, the two sleeve-like parts 22 and 23 of the lining which are made of high strength material can have projections or the like by means of which they produce a connection with the respective hinge pin 5 or 6 which connection is secured in the circumferential direction and is arranged in such a manner than when the hinge is actuated, the hinge pin 5 or 6, supported in the bushings 17 and 18 in a maintenance-free manner, rotates by means of the linings 21 of high strength material which are connected therewith.

Insofar as the bearing of the hinge pin 5 in the two external eyes 10 of the other hinge wing 13 is concerned, it is effected with a running fit and the lining 21 of high strength material may be secured against movement in the axial direction by means of ring or annular elements 25.

Figure 5:
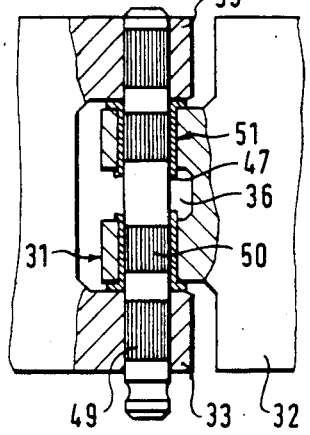
FIG. 5 is a sectional view showing a further embodiment of the invention.
Figure 6:
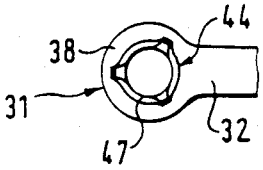
FIG. 6 is a front view of a bearing bush of high strength material shown in an assembled state.
Figure 7:
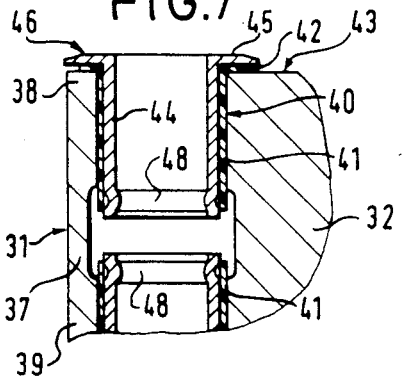
FIG. 7 is a sectional view through a center hinge eye of one hinge wing with inserted bushings of high strength material.
Figure 8:
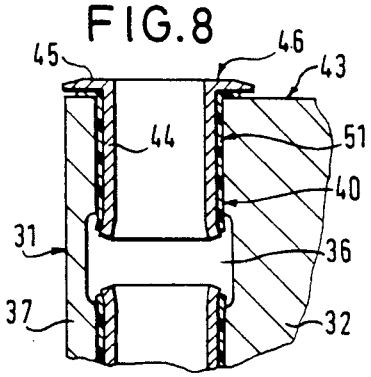
FIG. 8 is a sectional view through the center hinge eye of one hinge wing with bushings of high strength material inserted and locked against axial migration.
Figure 9:
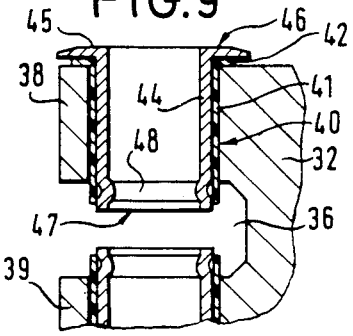
FIG. 9 is a sectional view through the center hinge eye of one hinge wing with inserted bushings of high strength material and outwardly open recess means directed transversely relative to the hinge axis.

In the embodiments shown in FIGS. 4–10, the door hinges are shown to consist of a first hinge wing 32 having a central hinge eye 31 and a second hinge wing 34 having two external hinge eyes 33 with a hinge pin 35 also being provided. The center hinge eye 31 of the first hinge wing 32 is provided with a recess 36 which is directed transversely relative to the hinge axis. The recess 36 can either be bigger than the hinge eye bore hole, as shown in FIGS. 4, 5, 9 and 10, or it may be only slightly larger, as shown in FIGS. 7 and 8. In the construction of an embodiment such as that shown in FIGS. 7 and 8, a web or bridge member 37 extends across the recess 36 between the two remaining sections 38 and 39 of the center hinge eye 31 of the hinge wing 32 and is retained in the head area of the hinge section.

Figure 4:
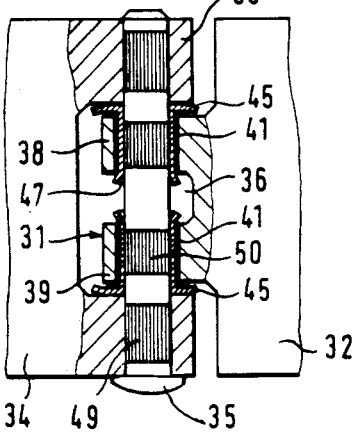
FIG. 4 is a sectional view showing another embodiment of the invention which comprises a separable motor vehicle door hinge with a hinge pin supported in a maintenance-free manner.

In the embodiment shown in FIG. 7, and in other similar embodiments, a collar bush 41 of maintenance-free material is provided which overlaps an external end face 43 of the center hinge eye 31 of the hinge wing 32 with a collar 42. The bushing 41 is inserted in the hinge eye bore hole 40 of the remaining sections 38 and 39 of the center hinge eye 31 of the hinge wing 32. Inserted in the bushing 41 which is made of maintenance-free bearing material is a bushing or liner 44 which is made of high strength material which is also constructed as a collar bush, whose collar 45 overlaps the collar 42 of the collar bushing 41 and whose collar 45 has an outwardly reduced tapered smoothing 46 in the area of its circumferential border. The collar bush 42 of maintenance-free bearing material and the collar bush 44 of high strength material are secured against axial migration in the hinge eye section 38 and 39 assigned thereto, respectively, wherein the securing in the embodiment shown in FIG. 4 is formed in a similar manner as in the embodiment shown in FIGS. 8 and 10 by means of a radially directed spreading of an end 47 of the bushing of high strength material, which end faces its collar 45.

In the embodiment shown in FIGS. 6 and 7, the bushing 44 of high strength material has, at its end 47, which faces the collar 45, a circulating radial and inwardly directed bead 48 which effects an outward spreading of the end 47 when the hinge pin 45 is driven into the assembly and accordingly operates to fix the bushing 44 with respect to its assigned section 38 and 39 of the center hinge eye 31 of the hinge wing 32.

In place of the circulating radial bead 48, shown in the embodiment described, bulges or the like can, of course, also be provided. To the extent that radially directed bulges, which are merely located at certain points, are provided at the bushing 44 of high strength material, these bulges can also be formed outwardly in such a way that the bushing of high strength material is clipped with the hinge eye sections 38 and 39, respectively, during insertion thereinto.

Additionally, as will be seen from the embodiments depicted in the drawings, the bushing 41 of bearing material is slightly longer than its assigned section 38 or 39 of the center hinge eye 31 of the hinge wing 32, and the bushing 44 of high strength material is at least slightly longer than the bushing 41 of maintenance-free bearing material. It is thereby ensured that by means of spreading of the inner free end of the bushing 44 of high strength material, that the bushing or liner 41 of maintenance-free bearing material is also fixed against migration in the axial direction at the same time with respect to the hinge eye sections 38 and 39.

As will be seen from FIGS. 4 and 5 in particular, the hinge pin 35 has a circumferential section which is formed as a circumferential knurl 49 and 50 extending over those longitudinal sections of the pin by means of which it must engage in the external hinge eyes 33 of the hinge half 34 on the one side and over those longitudinal sections by means of which it engages in the bushings 44 of high strength material on the other side. The hinge pin is thereby nonrotatively affixed with the external hinge eyes 33 of the hinge half 34 on the one side and with the bushings 44 of the high strength material on the other side and the one hinge wing 32 is supported at the hinge pin 35 in a maintenance-free manner by means of the bushings 41 of the maintenance-free bearing material.

Figure 10:
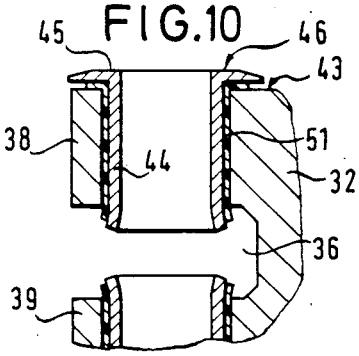
FIG. 10 is a sectional view through the center hinge eye of one hinge wing with bushings of high strength material inserted and locked against axial migration and with an outwardly open recess directed transversely relative to the hinge axis.

In the embodiment shown in FIG. 5, the bushings 44 of high strength material are provided at their outer circumference with a coating 51 of maintenance-free bearing material. This has the particular advantage that the bushings of maintenance-free bearing material and the bushings of high strength material can be assembled in one piece in common. In a case where bushings 44 of a high strength material are employed which are provided at their outer circumference with a coating 51 of maintenance-free bearing material, it is advisable as shown in FIGS. 8 and 10 to fix the bushings in the sections 38 and 39 of the center hinge eye 31 of the hinge wing 32, which sections 38 and 39 are assigned thereto, by means of radially spreading their end facing the collar 45.

Another possibility for fixing the bushings of high strength material in their assigned sections 38 and 39 of the center hinge eye 31 of the one hinge wing 32, is shown in FIGS. 5 and 6. The bushings of high strength material are provided in the area of their end 47 facing the collar 42 with axially directed, free cut tabs 52 which are bent outwardly after inserting the bushings 44 of high strength material in their assigned sections 38 and 39 of the center hinge eye 31 of the one hinge wing 32, as can be seen in particular from FIG. 6.

All the types of fastening of the bushings 44 of high strength material in their assigned sections 38 and 39 of the center hinge eye 31 of the one hinge wing 32, which types are shown in the drawing, have in common that they ensure a fixing of the bushing 44 of high strength material in a way that ensures that narrow tolerances are in turn maintained.

Thus, it will be seen that with the present invention, there is provided a hinge assembly for mounting a motor vehicle door supported in a maintenance-free manner which is supported in the central hinge eye of one hinge wing by a bushing of maintenance-free bearing material with running fit and which is fixed in at least one of the two external hinge eyes of the other hinge wing by means of a circumferential knurl so as to be nonrotatable relative to the hinge eye and in which the hinge pin has a shaping at its end face which makes possible a smooth insertion in the hinge and in which, in addition, a lining of high strength material is inserted in the bushing of maintenance-free bearing material in the center hinge eye of the one hinge wing. In accordance with the invention, it is suggested that in order to reduce the production costs required for maintaining narrow tolerances of the hinge bearing and in order to prevent a corrosion in the central areas of the center hinge eye of the one hinge area that at least one recess directed transversely relative to the hinge axis be arranged in the center hinge eye of the one hinge wing and a bushing of high strength material be arranged in each hinge eye section in connection with a bushing of maintenance-free material or a coating of maintenance-free bearing material, respectively, and that, in addition, the hinge pin have several sections provided with a circumferential shaping.

Thus, the invention may be found to extend to the bearing of the hinge pin with running fit in the two external hinge eyes of the other hinge wing, wherein collar bushes of maintenance-free material are arranged in the two external hinge eyes of the other hinge wing and are provided with a lining of high strength material while the hinge pin is fixed in the central hinge eye of the one hinge wing, which central hinge eye has a small bore hole width by means of a circumferential knurl so as to be nonrotatable therewith.

The lining of the collar bushes of maintenance-free bearing material is securely connected with the hinge pin, at least in the circumferential direction, when the latter is driven in or inserted, in such a way that it rotates with the hinge pin when the hinge moves and the bearing action of the collar bushings of maintenance-free material is maintained. The lining may consist of any known and suitable high strength material, such as, for example, steel or a woven or knitted fabric of carbon fibers or the like.

The fixing or pointing of the lining in the axial direction can be of use in attaching annular securing and holding members, particularly at the external hinge eyes of the other hinge wing. However, it can also be provided that the lining consist of two sleeve-like parts which can be connected with one another in the course of assembling the hinge, wherein the sleeve-like parts are constructed as collar bushings and possibly locked, clipped or otherwise connected with one another by means of alternately arranged engagement means provided at the end faces or front ends which face one another. The two sleeve-like parts could be provided with circulating radial slopings, bevels, chamfers or the like or recesses at their end faces which face one another and which may overlap or cover one another by means of these end face areas. However, the two sleeve-like parts could also be provided with projections or the like at their facing end faces by means of which projections they engage in a claw-like manner reciprocally and simultaneously also at the outer circumference of the hinge pin and, accordingly, connect therewith so as to be nonrotatable with the pin.

In another embodiment previously described, the bushings which are constructed as collar bushings of high strength material can be provided at one end with at least one radially directed projection or overhang which may be formed as a circulating or revolving collar which is reduced or tapered towards its circumferential border. The collar, compared with a radially directed projection extending nearly over an arc segment of the circumference of the bushings of high strength material, has the advantage that no consideration need be given to its position when inserting the bushing of high strength material in the assembly.

The bushings of bearing material are longer than the respective hinge eye sections, while bushings of high strength material are, in turn, somewhat longer than the bushings of bearing material and are provided in the area of the end facing their radially directed collar, or their radially directed projection, with inwardly or outwardly directed deformations which partly overlap the internal end face of the respective hinge eye section, at least when the hinge pin is assembled or mounted.

In particular, it may be provided in accordance with the present invention, that the bushings of high strength material be provided in the area of their end facing their collar with outwardly formed bulges which engage behind the inner end face of the respective hinge eye section when the bushing is mounted or assembled or that they be provided with an entirely or partially circulating, inwardly formed bead which effects an outwardly directed spreading of the free end of the bushing of high strength material when the hinge pin is driven in or inserted and, accordingly, ensures its fixing in the hinge eye section. However, it may also be provided that the bushings of high strength material be provided with axially directed, free cut tabs, or tabs which are cut free, in the area of their end facing their collar, which tabs are flanged outwardly when the bushing is mounted or that the bushings of high strength material be spread outwardly in the area of their end facing their collar after insertion in their respective hinge eye section.

Finally, a special characteristic feature of the invention will be found to consist in that it is provided that the bushings of high strength material inserted in the hinge eye sections be coated with maintenance-free bearing material at their outer circumference and a special bushing of maintenance-free bearing material is accordingly economized.

In order to eliminate the danger of corrosion in the area of the hinge eye bore hole of the center hinge eye, it can be further suggested, in accordance with the invention, that at least one extension directed transversely relative to the hinge axis be arranged in the center hinge eye of one hinge wing. Further, extremely narrow tolerances may be retained in that a bushing of high strength material is arranged in each of the remaining hinge eye sections in connection with the bushing of bearing material and in that the hinge pin has several sections located consecutively in the longitudinal direction having a circumferential shaping.

In order to enable assembly of the vehicle body and fitting and adjustment of vehicle doors in the body, the door hinges are provided with hinge pins which are only partially driven in wherein the hinge pin is driven into one of the external hinge eyes of the other hinge wing by only a part of the height of its circumferential knurl and can therefore be easily removed again when the door is to be removed. On the other hand, a subsequent insertion of the hinge pin to its full extent of its circumferential knurl ensures that the hinge pin will be fixed during the final installation of the vehicle door. This step is applied in a corresponding sense in hinge pins which have to have an interference fit in the center hinge eye of the one hinge wing.

Thus, from the foregoing, it will be seen that the present invention is particularly directed toward providing a hinge assembly wherein the hinge pin is shaped at its front end with a tapered configuration 5 which enables a smooth insertion of the pin into the hinge assembly. The invention is particularly characterized in that a lining 21 of high strength material is inserted in the bushing 17 of maintenance-free bearing material in the center hinge eye 9 of one hinge wing 11 and that the circumferential knurl 8 at the head part of the hinge pin 6 has at least one and one-half times the length required for securely fixing the hinge pin 6.

In accordance with a further, more detailed aspect of the invention, the assembly is characterized in that the hinge pin 5 is supported with a running fit in the two external hinge eyes 10 of the other hinge wing 13 by means of the bushings 18 of maintenance-free bearing material wherein the bushings 17 are provided with a lining 21 of high strength material, the lining 21 being connected with the hinge pin 5 so as to be nonrotatable therewith.

As a result of this construction, the specific advantages of the invention described above are obtainable.

While specific embodiments of the invention have been shown and described in detail to illustrate the application of the inventive principles, it will be understood that the invention may be embodied otherwise without departing from such principles.

What is claimed is:

1. A hinge assembly for supporting a motor vehicle door in a maintenance-free manner comprising:

a first hinge wing first hinge eye means;

a second hinge wing having second hinge eye means;

one of said first and said second hinge eye means comprising a center hinge eye and the other comprising two external hinge eyes juxtaposed with said central hinge eye therebetween;

a hinge pin operatively engaged between said first and second hinge eye means, said hinge pin being shaped at one end thereof to facilitate insertion into said first and second hinge eye means;

knurl means interposed between said hinge pin and one of said first and second hinge eye means to effect nonrotatable relative engagement therebetween;

bushing means made of maintenance-free bearing material interposed between said hinge pin and the other of said first and second hinge eye means; and liner means made of high strength material inserted in said bushing means between said hinge pin and said bushing means;

said knurl means extending over said hinge pin to nonrotatably affix said liner together with said hinge pin and said hinge pin together with said one hinge eye means.

2. An assembly according to claim 1, wherein said hinge pin is supported with a running fit in said two external hinge eyes by means of said bushing means and wherein said bushing means are provided with said liner means of high strength material, said liner means being connected with said hinge pin so as to be nonrotatable therewith.

3. An assembly according to claim 1, wherein said liner means consist of two sleeve-like members forming collar bushings having end face areas which face one another, said collar bushings being provided at said end face areas with one of radially directed alternate recesses, sloped surfaces, and alternately arranged axial projections.

4. An assembly according to claim 1, wherein said bushing means are constructed as collar bushings and wherein said liner means are provided at one end with at least one radially directed projection and have a radially directed collar which is reduced towards its circumferential border.

5. An assembly according to claim 4, wherein said liner means are provided with radially directed deformations which partially overlap said hinge eye means.

6. An assembly according to claim 4, wherein said liner means are provided with bulges which engage behind faces of said hinge eye means with said liner means in the assembled condition of said assembly.

7. An assembly according to claim 4, wherein said liner means are provided with inwardly formed beads which extend at least partially around said liner means.

8. An assembly according to claim 4, wherein said liner means are provided with axially directed free cut tabs at said radially directed collar, said tabs being bent radially outwardly with said liner means in the assembled condition of said assembly.

9. An assembly according to claim 4, wherein said liner means are spread outwardly in the area of their end facing said collar.

10. An assembly according to claim 1, wherein said bushing means are made of a length longer than the respective hinge eye means in which said bushing means is inserted, said liner means being longer than said bushing means.

11. An assembly according to claim 1, wherein said center hinge eye comprises at least one recess directed transversely relative to the axis of said hinge assembly and wherein said liner means is arranged in each of said hinge eye means in connection with said bushing means, said knurl means comprising a plurality of knurled sections formed on said hinge pin to extend circumferentially thereabout.

12. An assembly according to claim 11, wherein at least one of said recesses is inserted in said central hinge eye and wherein said liner means is formed as a coating of bearing material constructed as a collar bushing and inserted in the other of said hinge eye means secured against axial movement.

13. An assembly according to claim 1, comprising a pair of hinges each formed with said first and second hinge wings and with a hinge pin and each including said knurl means, said bushing means and said liner means, said hinges being arranged one above the other in such a way that the hinge pin of one of said hinges can be removed downwardly and the hinge pin of the other of said hinges can be removed upwardly.

14. A hinge assembly for supporting a motor vehicle door in a maintanenance-free manner comprising:

a first hinge wing having first hinge eye means;

a second hinge wing having second hinge eye means;

one of said first and said second hinge eye means comprising a center hinge eye and the other comprising two external hinge eyes juxtaposed with said central hinge eye therebetween;

a hinge pin operatively engaged between said first and second hinge eye means, said hinge pin being shaped at one end thereof to facilitate insertion into said first and second hinge eye means;

knurl means interposed between said hinge pin and one of said first and second hinge eye means to effect nonrotatable relative engagement therebetween;

bushing means made of maintenance-free bearing material interposed between said hinge pin and the other of said first and second hinge eye means; and liner means made of high strength material inserted in said bushing means between said hinge pin and said bushing means and being fitted within said bushing means for rotation relative thereto;

said knurl means extending to between said liner means and to between said hinge pin and said one hinge eye means to retain said liner means and said one hinge eye means in rotatively fixed engagement with said hinge pin when said hinge assembly is in an assembled condition and to permit said hinge pin to be axially removed from and replaced in said hinge assembly without damage to said bushing means.

* * * * *